United States Patent [19]

Wittrisch

[11] Patent Number: 4,898,240

[45] Date of Patent: Feb. 6, 1990

[54] SYSTEM FOR MOVING A SET OF INSTRUMENTS AND A METHOD FOR MEASUREMENT AND/OR INTERVENTION IN A WELL

[75] Inventor: Christian Wittrisch, Rueil Malmaison, France

[73] Assignee: Institut Francais du Petrole, Rueil Malmaison, France

[21] Appl. No.: 257,311

[22] PCT Filed: Dec. 30, 1987

[86] PCT No.: PCT/FR87/00520

§ 371 Date: Aug. 31, 1988

§ 102(e) Date: Aug. 31, 1988

[87] PCT Pub. No.: WO88/05109

PCT Pub. Date: Jul. 14, 1988

[30] Foreign Application Priority Data

Dec. 31, 1986 [FR] France ..... 86 18413

[51] Int. Cl.[4] ..... E21B 23/00; E21B 47/00

[52] U.S. Cl. ..... 166/250; 166/65.1; 166/308; 166/382; 166/385

[58] Field of Search ..... 166/250, 254, 255, 252, 166/381, 308, 382, 385, 387, 64, 65.1, 66, 69, 72, 77; 175/40, 45, 50, 61, 62, 104, 317, 318

[56] References Cited

U.S. PATENT DOCUMENTS

| | | | |
|---|---|---|---|
| 4,349,072 | 9/1982 | Escaron et al. | 166/250 |
| 4,457,370 | 7/1984 | Wittrisch | 166/250 |
| 4,484,628 | 11/1984 | Lanmon, II | 166/250 |
| 4,485,870 | 12/1984 | Walulik | 166/250 |
| 4,488,597 | 12/1984 | Hoppe et al. | 166/250 |
| 4,500,155 | 2/1985 | Chevalier | 339/94 M |
| 4,570,709 | 2/1986 | Wittrisch | 166/250 |
| 4,609,005 | 9/1986 | Upchurch | 137/68.1 |
| 4,664,189 | 5/1987 | Wittrisch | 166/66 |
| 4,690,214 | 9/1987 | Wittrisch | 166/250 |

FOREIGN PATENT DOCUMENTS

| | | |
|---|---|---|
| 2564894 | 11/1985 | France . |
| 2573472 | 5/1986 | France . |

*Primary Examiner*—Bruce M. Kisliuk

*Attorney, Agent, or Firm*—Antonelli, Terry & Wands

[57] ABSTRACT

System for displacing a set of instruments for taking measurements and/or carrying out interventions in a well, the system being remote controllable from the surface between two positions. The invention also relates to a method for taking measurements and/or intervening by using said system. The system, according to the invention, is particularly characterized in that it comprises a body (6a) inside which there is arranged a support (9), said body cooperating with said support to provide for a displacement of the support relative to said body, said support having its displacement stroke limited by means of two stops (11, 12) which are integral with said body, said support being mechanically connected to said set of instruments (2) by means of a connection shaft (13), said system being deprived of reversible locking means. The method according to the invention is particularly characterized in that, through displacements of the support and bringing the assembly to a standstill, the tension of the connection shaft (13) is released. The invention applies particularly to measurements and/or interventions that are carried out in ground drilling, during a hydraulic fracturation operation.

13 Claims, 3 Drawing Sheets

SYSTEM FOR MOVING A SET OF INSTRUMENTS AND A METHOD FOR MEASUREMENT AND/OR INTERVENTION IN A WELL

The present invention relates to a method and a system allowing measurements and/or interventions to be made in a well at the level of the surrounding formations, in particular measurements of noises or vibrations for which the instruments must be mechanically uncoupled from the casing through which mechanical waves are transmitted, particularly from the surface.

The measurements made may, for example, include triaxial recording of noises produced by the rocks stressed in this manner. Analysis of vibrations detected allows the orientation of the noise source and hence the direction of propagation of the fracture to be defined. This analysis technique is well known to geophysicists and will not be described here in greater detail.

The invention applies in particular when measurements such as vibration measurements are to be made at the level of geological formations of a well located in a zone, or near to a zone, of this well or another well where hydraulic fracturing is being carried out.

The measurements made may also include recording the pressure and temperature at the bottom and measurement (focused or unfocused) of the electrical resistivity of the formations, etc.

These measurements may be supplemented by viewing the well walls with a television camera, for example.

One of the purposes of the invention is to provide a device allowing a measuring or intervention instrument to be moved in a well zone.

French Pat. Nos. FR-2,544,013, 2,564,894, and 2,573,472 already teach methods and devices for carrying out measurements and/or interventions in a well of which one zone is subjected to hydraulic compression, but the devices and methods proposed heretofore exhibit certain drawbacks in use, such as inaccuracy in maneuvering the support of the set and hence the instruments, risks of the support becoming jammed in the casing particularly because of W-shaped groove, and undesired uncoupling of the transmission cable and the support during maneuvers.

These drawbacks are eliminated, or at least very substantially attenuated, by the use of the system for moving a set of measuring and/or intervention instruments in a well according to the invention, as well as the method applicable thereto.

This system, controllable at a distance from the surface, i.e. controllable remotely, between a first position and a second position different from the first position, comprises in particular a body inside which is placed a support, whereby the body cooperates with the support to ensure movement of the support relative to the body, and the travel of the support is limited by means of two stops integral with the body, said support being mechanically connected to said set of instruments by a shaft, the system having no reversible locking means.

The system may have hydraulic means allowing the support to be moved relative to the body by the pumping of fluid.

The interior of the body may be cylindrical in shape.

The body may be place in a tube with a tubular clearance, whereby the dimensions of the clearance are greater than the dimensions of the tube.

The system may have return means such as a spring allowing the support to assume either of the positions defined above, by default.

When the system has a cable connected to the surface, one of whose ends is attached to a loading bar and has means for moving the suspension cable, the support may have a bar-centering guide and means designed to fasten the bar to the support, said connecting means being capable of being moved aside.

When the set is electrically connected to the surface, the device may have an electrical transmission cable connected to the surface, one of whose ends has a connecting plug pluggable in a liquid medium, designed to cooperate with a matching socket integral with the support, the matching socket being connected to said set by a electrical connecting cable.

The connecting means may include a drive element and a receiving element cooperating with the drive element, whereby the drive element is integral with the loading bar and is driven from the surface by means of a control line.

The system may have means for destroying the support locking it in the first position, said means being capable of being moved aside to permit measuring or intervention by the set.

When a first zone in which the set is located is hydraulically isolated from a zone external to said first zone, the support may be designed to cooperate with the body to provide a seal and prevent any leakage of fluid in either direction between the first zone and the outer zone.

The system may comprise means for damping the movements of the support in the vicinity of the stops.

The invention also supplies a measuring or intervention method in a well by means of a set of instruments wherein a movement system devoid of reversible locking means is used, in which system set located at the lower end of a casing is introduced into the well, set being connected to a matching socket by an electrical connecting cable, the socket being integral with the support, the shaft connecting said support to the set of instruments being flexible, then a suspension cable and a transmission cable equipped with an electrical connecting element designed to connect to the support and to the matching socket are introduced into the casing, the system being in the second position, the first position being located between the second position and the surface, along the casing.

This method is characterized in particular by a pull being exerted on the suspension cable such as to place the support in the first position in which the shaft is tensioned, then the set of instruments is immobilized relative to the well wall while a pull is maintained, and the pull on the shaft is released by bringing the support into the second position before carrying out the measurement and/or intervention.

When the method is used for a well at least one zone of which undergoes hydraulic compression, the compression zone may be delimited by means of at least one annular expandable sealing element placed between the casing and the wall and, depending on whether the instrument set is located in said zone, the zone in which the instrument set is located is or is not isolated from the zone subjected to compression.

Other goals and advantages of the present invention will emerge from reading the description of an example applied more particularly to measuring and/or intervention in a well of which one zone is subjected to hydraulic compression, said example being provided for illustration but not to be construed limitatively, with reference to the attached drawings wherein.

Figure 2:
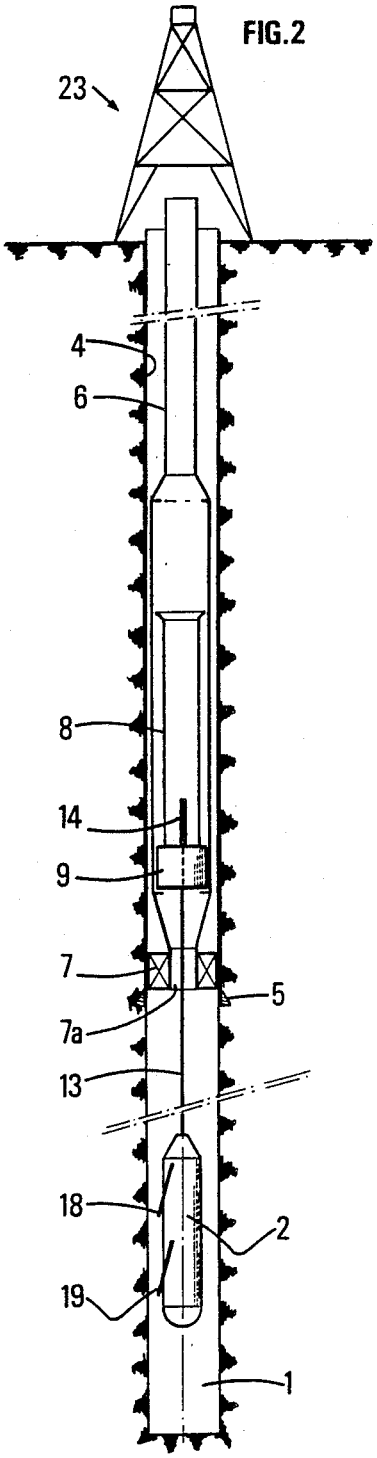
FIGS. 2 to 5 illustrate the various phases of implementing an embodiment of the system according to the invention applied to hydraulic fracturing operations.
Figure 3:
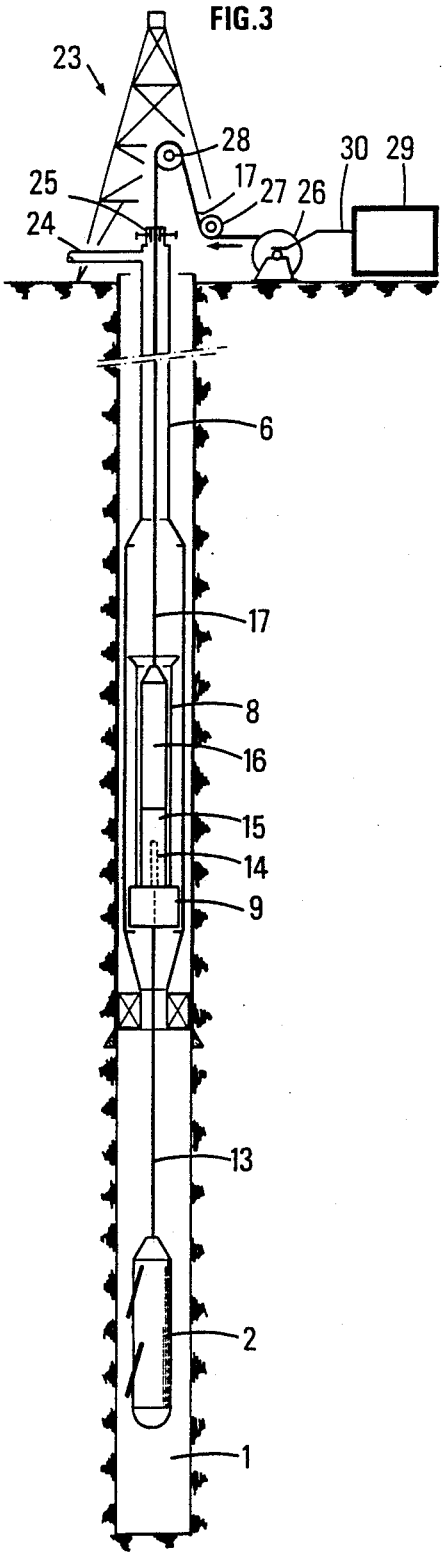
Figure 4:
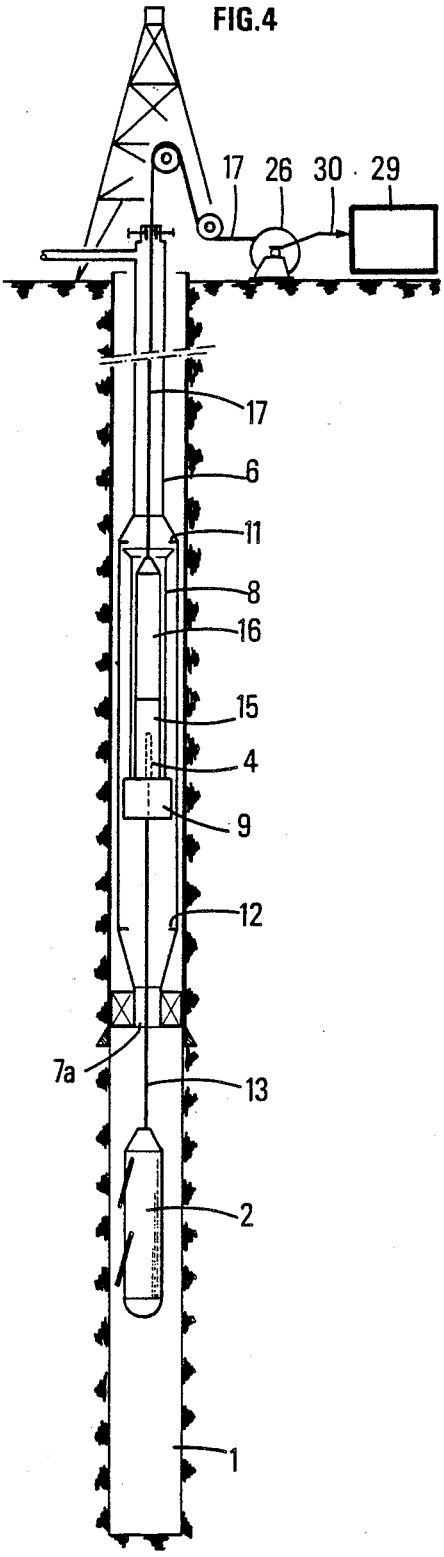
Figure 5:
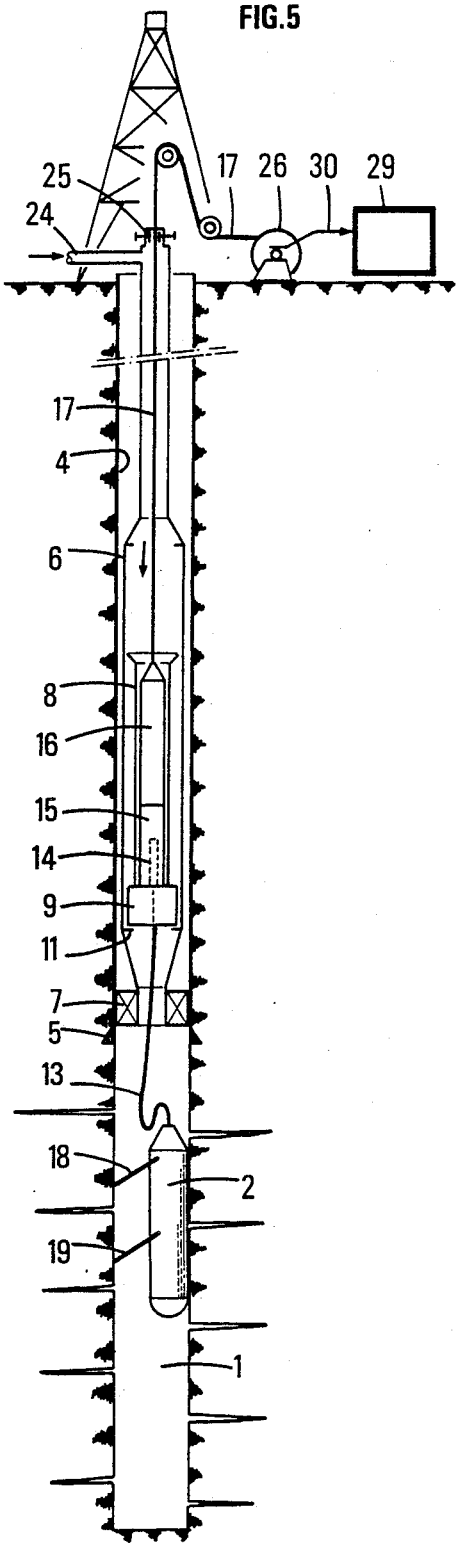

FIG. 2 shows schematically the phase wherein the set of instruments and the system according to the invention are lowered into the well, FIG. 3 shows schematically, substantially in the measuring and/or intervention position of the set, the phase of connection and anchoring of the transmission cable to the support, FIG. 4 shows schematically the phase in which the set is raised just before it is anchored to the well, FIG. 5 shows schematically the phase in which the connecting cable located between the set and the support according to the invention is slackened.

Figure 1:
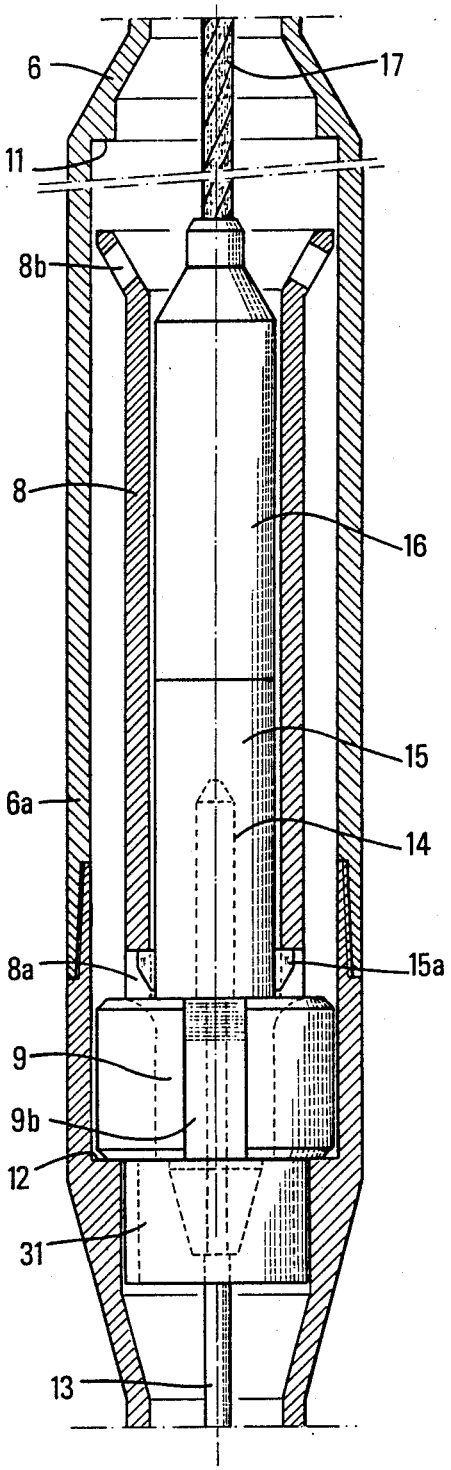
FIG. 1 shows in detail one embodiment of a system according to the invention.

In FIG. 1, which represents one embodiment of a system according to the invention, reference 6 represents a casing, located inside a well, which includes the system for moving a set consisting of one or more measuring and/or intervention instruments. This system has a support 9 from which is suspended, by a connecting shaft such as a flexible shaft or a cable 13, a set of instruments (not shown) and a body 6*a* integral with casing 6 inside which slides guided support 9 of the instrument set.

The travel path of the support 9 relative to body 6*a* is limited by means of an upper stop 11 and a lower stop 12.

Support 9 as well as internal shoulders 11 and 12 have recesses or bores allowing a hydraulic fluid to flow along casing 6, around centering guide 8, in both positions of probe 2 comprising the set of instruments as shown in FIG. 2.

This centering guide 8 may have a tubular support as illustrated in the figures.

Support 9, like all the elements integral therewith such as centering guide 8, may cooperate with body 6*a* to come into contact with stops 11 and 12.

By convention, during the present description, and not limitatively, it will be considered that the support is in a first position when it is in contact with upper stop 11 and in a second position when it is in contact with lower stop 12.

The inside shape of body 6*a* like the outside shape of support 9 is advantageously cylindrical, but any other shape allowing support 9 to slide in body 6*a* located in casing 6 may be used.

The command for movement of the support may be given from the surface via a suspension cable 17.

Since, when the casing is mounted by operating elements, suspension cable 17 which passes inside the casing may not be put in position until well after the movement system has been lowered into the well, hence the mechanical link allowing the cable to be fastened to the support must be separable. Thus, cable 17 is provided at its lower end with a loading or ballast bar 16, allowing cable 17 to be lowered into casing 6.

In the vicinity of support 9, bar 16 is centered by guide 8 which may, as shown here, but not necessarily, be integral with support 9.

Once loading bar 16 has been centered in guide 8, it is made integral with the support by means of any appropriate device such as locking dogs 15*a* integral with bar 16 and cooperating with notches 8*a* located in support 9, or in centering guide 8 when the latter is integral with the support.

The integration means, which can be moved aside, comprise a drive element, preferably integral with the loading bar so as to be remotecontrolled as directly and as simply as possible, and a receiving element, preferably integral with support 9, designed to cooperate with the drive element to ensure integration.

The drive element, such as electrical or electrohydraulic locking dogs, is controlled from the surface by an electric line associated with suspension cable 17. Once the cable has been made integral with the support, it is possible to place it by traction in the first position. Return of the support to the second position is effected by the action on the support of gravitational or hydraulic forces produced by a sufficient flow of fluid.

Support 9 and the flared part of centering guide 8 are provided with channels 9*b* and 8*b* respectively, suitably dimensioned, allowing passage of the drilling fluid, particularly with a view of producing hydraulic fracturing in a zone located under the support level.

Fastening of cable 17 to support 9 is particularly useful when the instrument set is to be connected to the surface. For accomplishing this, cable 13 may be provided with feed lines and/or measuring transmission lines such as electrically conducting lines, connected with a male connecting plug 14 integral with support 9 and cooperating with a matching female socket 15 placed on loading bar 16, which socket 15 is connected to the surface by transmission lines associated with suspension cable 17.

Examples of electrical connectors usable to constitute the male plug 14 plus female socket 15 assembly are described in U.S. Pat. No. 4,500,155.

Plug 14 and socket 15 are placed on the support axis and are connected when support 9 is fastened to suspension cable 17 provided with loading bar 16.

When support 9 has hydraulic means designed for pumping the support, such as seals or waterstops, by pumping fluid either into the casing or into the annular zone, one may bring support 9 into either position without having to resort to a suspension cable.

In the same way, the free end of the cable which is to be connected to the support may be provided with a drive plug, allowing the fluid-pumping means to move the free end of the cable.

FIG. 2 shows schematically the phase in which the instrument and the system for moving this set located at the lower end of a casing is lowered into the well.

Well 1 is equipped over a certain length with a lining 4 ending in shoe 5 at its lower part.

Hereinafter it is deemed, as an example, that instrument set 2 has a well-logging probe, but it could also have a television camera or an intervention instrument such as a drilling tool, etc.

An annular sealing element 7, radially expandable, which may be of a classic packer type, is placed at the lower end of casing 6.

Radial expansion of this element is obtained for example by axial displacement of casing 6, causing spreading of the anchoring wedges of the packer. One might also use a hydraulic anchoring packer of a known type, for example model AD1 offered by the Baker Oil Tools Company.

In its expanded position, this element 7 is pressed against lining 4. Support 9, surmounted by a centering guide 8, is accommodated in casing 6.

Probe 2 is connected to support 9 by a flexible link, i.e. a link with negligible stiffness which, in the embodiment illustrated, is composed of a support cable 13 traversing an axial passage 7*a* of element 7.

Cable 13 contains electrical conductors and measurement-transmission conductors which electrically connect probe 2 to a male multi-contact electrical plug 14 located on support 9. This male plug is designed to fit a matching female socket 15 surmounted by a loading or ballast bar 16.

Probe 2 may, for example, be of the known type and have articulated anchoring arms 18, 19 which fold along the probe body when this probe is lowered into the well, said arms being deployed hydraulically by electrical remote control from the surface via cables 17 and 13. When it is desired to place probe 2 in its operating position shown in FIG. 5, arms 18 and 19 are then anchored in the well wall and press probe 2 against this wall on the diametrically opposite side. These arms may be connected to one or more skids applied against the well wall.

In one embodiment where probe 2 is used to detect and record acoustic signals produced by geological formations fissured by hydraulic fracturing, this probe may in particular have dynamic triaxial accelerometers recording noise components $A_x$, $A_y$, and $A_z$ along three mutually perpendicular axes and pressure sensors respectively measuring the hydrostatic pressure prevailing in the well outside the probe and the application pressure of arms 18 and 19 against the wall.

This probe may also have instruments which in known fashion determine its inclination to the vertical (static accelerometers or inclinometers) and the orientation of a tool face of this probe with respect to magnetic north (triaxial magnetometers or compass).

FIG. 2 illustrates the first stage in which first of all packer 7 is attached at the surface to the lower end of casing 6. Support 9 fitted with centering guide 8 is then introduced into the casing and is disposed vertically by passing through packer 7 the electrical cable 13 previously being connected to support 9. The probe (or intervention tool) 2 is then attached under packer 7 to the lower end of cable 13, and is thus suspended under casing 6.

The set is then steadily lowered into well 1 from derrick 23 by adding successive elements of casing 6 until probe 2 reaches the desired depth, essentially at the level of shoe 5 in FIG. 2, the number of casing elements 6 connected end to end giving information at all times on the depth reached. When this position is reached, packer 7 is anchored to the lower end of lining 4 (FIG. 2).

As shown in FIGS. 3 and 5, casing 6 is connected at its upper part to a pressurized hydraulic fluid line 24 and is fitted at its tip with a safety stopper or stuffing box 25 in which cable 17 is slid to retain the assembly formed by loading bar 16 and female socket 15 until the latter is connected to male plug 14 attached to support 9 which supports the probe, whereby centering guide 8 provides guidance for assembly 15–16 to facilitate this connection (FIG. 3).

Locking or mechanical linkage elements 15*a* and 8*a* are matched to socket 15 and to the internal wall of guide 8, respectively, said elements being designed to release when a signal is given from the surface.

Cable 17 is paid out from the surface by a winch 26. Between winch 26 and stopper 25, cable 17 passes over return pulleys 27 and 28.

When the operations involving electrical connection of socket 15 with plug 14 as well as mechanical linkage between bar 16 and support 9 are accomplished, a pull F exerted on cable 17 (FIG. 4) raises the support which then moves into the top position or first position corresponding to FIG. 4.

In this position, opening of articulated arms 18 and 19 is remote-controlled from station 29 by means of cable 17 and 13. The ends of these arms become anchored in the wall of well 1, pressing probe 2 against the wall portion diametrically opposite these arms (FIG. 5).

The pull exerted on cable 17 from the surface is eased, and support 9 falls back into its bottom or second position under the influence of gravity. This has the effect of conferring some slack on cable 13, which is thus released (FIG. 5).

Without the length of travel limiting utilization of the system according to the invention, a distance between stops of 50 cm may be sufficient for mechanical uncoupling of the probe from its support. Thus, for example, when it is desired to uncouple set 2 from casing 6 electrically, the travel of support 9 inside body 8*a* may be several meters.

This being the case, it will now be possible to make measurements or to conduct operations by means of the probe or instrument 2 without transmitting to this probe or instrument the vibrations of casing 6.

The remote-control signals to probe 2 from the surface, as well as the measuring signals from probe 2 and the electrical current supplying the latter, are transmitted respectively from and to the surface station 29 via conductors built into cables 13 and 17, with the electrical link between these conductors and station 29 being provided in known fashion by a set of brushes rubbing on collector rings integral with the shaft of winch 26.

The hydraulic fracturing of the formations located below packer 7 may be accomplished by pumping hydraulic fluid under pressure through line 24 located at the surface.

When the various measuring operations are complete, closing of articulated arms 18 and 19 is remote-controlled from the surface.

Suspension cable 17 is detached from support 9, causing the dogs to disengage from the surface, then female electrical socket 15 is disconnected from male plug 14. The assembly consisting of female socket 15 and loading bar 16 above this socket can then be raised by means of cable 17.

The probe remains suspended under casing 6 by connecting cable 13. Casing 6 may then in turn be steadily pulled out of the well, with the elements of this casing being successively disconnected at the surface.

It would not, however, be beyond the scope of the invention to place the equipment assembly 8, 9 at a lower level than that of sealing element 7, whose axial passage 7*a* would then be traversed by transmission cable 17.

In addition, other means of implementing the equipment defined above are also possible.

It would, for example, be possible to place sealing element 7 in a non-cased zone of the well which will be isolated from the rest of the well by using a sealing organ which completely seals the well at a lower level that that of the instrument or probe, in its bottom position.

According to one version of the latter embodiment, lining 4 is lowered under the total sealing element defined above. In the zone delimited by the two sealing elements, lining 4 is perforated in classical fashion to permit the hydraulic fluid injected to flow through the formations located at this level.

When the entire device is under hydraulic pressure, it is possible to move the instrument or probe 2 merely by pulling cable 17 from the surface, after closing arms 18 and 19 by remote control.

By isolating one zone of the well by sealing elements, it is possible to produce fracturing therein while, in a zone lower than that of the fracturing zone, measurements and/or interventions are being carried out. For this purpose, support 9 must be designed to cooperate with body 8*a* to ensure tightness and prevent any fracturing fluid from flowing from said fracturing zone to said zone in which the measurements and/or interventions are taking place.

To provide this seal between support 9 and shoulder 12, the support is free of channels 9*b*, or at least the support is designed such that the fluid contained in the casing does not escape from it via these channels. A check valve preventing this circulation of fluids may also be used.

In addition, packing placed between support 9 and shoulder 12 integral with the support or with body 8*a* may supplement this seal.

When the use of a protective housing surrounding probe 2 is necessary while the probe is being lowered into the well, to maintain the probe in the housing one may lock the support in a first position by means which are destroyed under the action of the forces acting on the support, such as hydraulic forces or those produced by the weight of the loading bar. The probe is uncoupled from the casing when the support has reached its second position when the probe has emerged from its protective housing.

When the means of attaching loading bar 16 to support 9 are of a type requiring support 9 or centering guide 8 to be in contact with shoulder 11, it is possible to allow the loading bar to be detached from the support. As in the case where detachment is effected by shearing of a mechanical part, a device damping the support for at least the end of its fall toward lower stop 12 may be used.

A damper of the hydraulic type may be composed of two jackets one of which is integral with support 9 and which cooperates with another jacket, 31, integral with body 6*a* to define a chamber. The fluid volume of this chamber decreases when the support nears the second position and is evacuated by nozzles calibrated for this purpose.

According to another embodiment of the invention used in a vertical or slightly inclined position, the device has a spring or any other return means allowing the support to assume the first position by default when the probe is held by the support and the loading bar is not yet anchored. Then, under the effect of the (apparent) weight of the loading bar, the spring compresses until the support reaches the second position.

This device is particularly applicable to sets of instruments which, when lowered, must be placed inside a housing in order to be protected there, with the first position corresponding to the probe located in the housing and the second position to the probe outside the housing and uncoupled from the casing.

I claim:

1. A system for moving a set of measuring and/or intervention instruments in a well which is maneuverable remotely from the surface between a first position and a second position different from the first position, said system comprising a casing having one end located at the surface and another end located within the well and a body inside of which is placed support means for supporting said set of instruments, said body being connected to the another end of the casing and cooperating with said support means to provide movement of the support means relative to the body, said support means being limited in travel by means of two stops integral with said body and said support means being mechanically linked to said set of instruments by a connecting shaft; said system being devoid of reversible locking means between said support means and said body.

2. A system according to claim 1 characterized by having hydraulic means allowing movement of said support means relative to the body by pumping of fluid.

3. A system according to claim 1, characterized by the inside of said body having a cylindrical shape.

4. A system according to claim 1, characterized by said body being provided in a tube having a tubular clearance, the dimensions of said clearance being larger than the dimensions of the tube.

5. A system according to claim 1, characterized by having return means such as a spring allowing the support means to assume either of said positions.

6. A system according to claim 1 having a cable connected to the surface, one end of which has a loading bar and having means for moving said cable, characterized by said support means having a centering guide for said bar and means for fastening said bar to said support means, said fastening means being capable of being moved aside.

7. A system according to claim 6, characterized by said fastening means comprising a drive element and a receiving element cooperating with said drive element, said drive element being integral with said loading bar and being driven from the surface by means of a control line.

8. A system according to claim 1 wherein the set is electrically connected to the surface, characterized by having an electrical transmission cable connected to the surface, one of whose ends has a connecting plug, pluggable in a liquid medium, designed to cooperate with a matching socket integral with said support means, said matching socket being connected to said set by an electrical connecting cable.

9. A system according to claim 1, characterized by having means for destroying a locking means for holding said support means in said first position, said locking means being moved to allow said measurement or said intervention by the set.

10. A system according to claim 1 wherein a first zone in which said set is isolated hydraulically from a zone outside said first zone, characterized by said support means being designed to cooperate with said body to provide a seal and prevent any flow of fluid in one direction and/or in the other between said first zone and said outer zone.

11. A system according to claim 1 characterized by having means allowing the movements of support means in the vicinity of stops to be damped.

12. A method for effecting measurement and/or intervention in a well by remote control from the surface with a set of instruments wherein a system of movement having two positions is employed, said system being devoid of reversible locking means between a support means for the set and a body secured to a lower end of a casing, wherein said casing and said set is introduced into the well, said set being connected to a matching socket by an electrical connecting cable, said socket being integral with support means, a connection shaft equipped with an electrical connecting element being adapted to be connected to the support means and to the matching socket being introduced into the well, said system being in a second position, said first position being located along the casing between the second position and said surface, said method being further characterized by exerting a pull on a suspension cable attached to said support means to bring the support means into the first position, said connecting shaft being under tension, then by immobilizing said set of instruments relative to a well of the wall while maintaining the pull on said suspension cable, then releasing the tension from the connection shaft and bringing said support means into second position before carrying out the measurement and/or intervention.

13. A method according to claim 12 operative in a well having at least one zone to be subjected to hydraulic compression further comprising delimiting the compression zone by means of at least one annular expandable sealing element located between the casing and a well of the wall and depending on whether the set is or is not located in said zone, the zone in which the instrument set is located is or is not isolated from the zones objected to compression.

* * * * *